US006110601A

United States Patent [19]

Shaw-Klein et al.

[11] Patent Number: 6,110,601

[45] Date of Patent: Aug. 29, 2000

[54] INK JET RECORDING ELEMENT

[75] Inventors: Lori J. Shaw-Klein, Rochester; Richard J. Kapusniak, Webster, both of N.Y.

[73] Assignee: Eastman Kodak Company, Rochester, N.Y.

[21] Appl. No.: 09/224,531

[22] Filed: Dec. 31, 1998

[51] Int. Cl.[7] ..... B41M 5/00; B41J 2/01

[52] U.S. Cl. ..... 428/522; 347/106; 428/195; 428/331; 428/341; 428/342

[58] Field of Search ..... 347/105, 106; 428/195, 331, 341, 342, 522

[56] References Cited

U.S. PATENT DOCUMENTS 5,521,002 5/1996 Sneed ..... 428/195

FOREIGN PATENT DOCUMENTS 0 199 874 11/1986 European Pat. Off. .

*Primary Examiner*—Pamela R. Schwartz
*Attorney, Agent, or Firm*—Harold E. Cole

[57] ABSTRACT

An ink jet recording element comprising a water-impervious support having thereon the following layers:

a) a water-absorbing layer; and b) an image-recording layer comprising a colloidal oxide and a pigment dispersed in a binder, the binder comprising a mixture of poly(ethylene glycol) having a molecular weight of from about 1400 to about 35,000 and poly(vinyl alcohol), the ratio of the poly(ethylene glycol) to the poly(vinyl alcohol) being from about 1:0.8 to about 1:1.5.

10 Claims, No Drawings

INK JET RECORDING ELEMENT

FIELD OF THE INVENTION

The present invention relates to an ink jet image-recording element which yields printed images having a matte finish, superior ink absorption, image quality, water resistance, color rendition and lightfastness.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., no coalescence of adjacent ink dots, which leads to nonuniform density
- Exhibit no image bleeding, i.e., no unsharp edges
- Provide maximum printed optical densities
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light If an ink jet receiver is desired to have structural rigidity, dimensional stability, and resistance to cockling or tearing, then the ink receptive layer should be coated on an ink solvent-impervious support such as a continuous polymeric web or a polyolefin-coated paper. When such a support is used, there is no fibrous material in contact with the ink solvents, so that drying of the printed ink must be provided entirely by the coated layers.

DESCRIPTION OF RELATED ART

EPA 199 874 discloses ink receptive layers for an ink jet receiver which contain polyethylene oxide, white pigment, poly(vinyl alcohol), cationic resin and polyvalent salts. The pigment-containing ink receptive layer is coated directly on the support and the poly[]ethylene oxide) employed has a molecular weight in the range of 100,00 to 900,000. There is a problem with this receiving layer, however, in that it exhibits poor print light fade characteristics.

U.S. Pat. No. 5,521,002 relates to a matte-type ink jet receiver comprising a hydrophilic, water-soluble polymer, ethyl cellulose, polyalkylene glycol, and a porous inorganic filler. The polyalkylene glycol employed has a low molecular weight of less than 3,000. There is a problem with this receiver, however, since images transferred to it have a tendency to exhibit a defect known as "image bleed". Furthermore, organic solvents are used to coat such a formulation which is objectionable for health and environmental reasons.

It is an object of this invention to provide an ink jet recording element which has a matte finish, superior ink absorption, image quality, water resistance, color rendition and lightfastness. It is another object of this invention to provide an ink jet recording element which has resistance to image bleeding.

SUMMARY OF THE INVENTION

These and other objects are achieved in accordance with the invention which comprises an ink jet recording element comprising a water- impervious support having thereon the following layers:

a) a water-absorbing layer; and b) an image-recording layer comprising a colloidal oxide and a pigment dispersed in a binder, the binder comprising a mixture of poly(ethylene glycol) having a molecular weight of from about 1400 to about 35,000 and poly(vinyl alcohol), the ratio of the poly(ethylene glycol) to the poly(vinyl alcohol) being from about 1:0.8 to about 1:1.5.

The ink jet recording element of the invention produces an image which has a matte finish, superior ink absorption, image quality, water resistance, color rendition and lightfastness. The ink jet recording element also has resistance to image bleeding.

DETAILED DESCRIPTION OF THE INVENTION

The water-impervious support used in the invention can be, for example, treated or calendered paper, paper coated with protective polyolefin layers, polymeric films such as poly(ethylene terephthalate), poly(ethylene naphthalate), poly(1,4-cyclohexane dimethylene terephthalate), poly (vinyl chloride), polyimide, polycarbonate, polystyrene, or cellulose esters. The support should be selected to permit high printed densities, good image quality, dimensional stability, and resistance to cockle and curl. In a preferred embodiment of the invention, polyethylene-coated paper or poly(ethylene terephthalate) is employed.

The support is suitably of a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the water-absorbing layer to the support, the surface of the support may be subjected to a corona-discharge-treatment prior to applying the water-absorbing layer.

In addition, a subbing layer, such as a layer formed from a halogenated phenol or a partially hydrolyzed vinyl chloride-vinyl acetate copolymer can be applied to the surface of the support to increase adhesion of the water-absorbing layer. If a subbing layer is used, it should have a thickness (i.e., a dry coat thickness) of less than about 2 $\mu$m.

The water-absorbing layer used in the invention may be, for example, a hydrophilic colloid such as gelatin, albumin, guar, xanthan, rhamsan, wellan, acacia, tragacanth, carrageenan, chitosan, starches and their derivatives, and the like. Derivatives of natural polymers such as functionalized proteins, functionalized gums and starches, and cellulose ethers and their derivatives, may also be used as well as synthetic polymers. Examples of these materials include polyvinyloxazoline and polyvinylnethyloxazoline, polyoxides, polyethers, poly(ethyleneimine), poly(acrylic acid), poly(methacrylic acid), N-vinyl amides including polyacrylamide and polyvinylpyrrolidone, and poly(vinyl alcohol), its derivatives and copolymers. Suitable materials and their water absorption characteristics are described in "Water-Soluble Synthetic Polymers Properties and Behavior, Volumes 1 and 2", by Philip Molyneux, CRC Press, Inc., 1984.

In a preferred embodiment of the invention, the water-absorbing layer is gelatin. The layer should be sufficiently thick to aid in the absorption of the ink solvents (water) and to prevent image degradation due to bleed, etc., yet be as thin as possible in order to reduce material and manufacturing costs associated with the deposition of thick layers. In general, this layer is coated at a coverage of about 2 to about 16 g/m$^2$.

Many types of pigments may be used in the image-recording layer such as calcium carbonate, mica, kaolin, clay and the like. In a preferred embodiment of the invention, the pigment is precipitated amorphous silica since it is readily available and has a high degree of porosity which aids in ink drying and in controlling bleed. The pigment may be used in an amount of from about 0.8 g/m$^2$ to about 7 g/m$^2$, preferably from about 1 g/m$^2$ to about 5 g/m$^2$.

As described above, the binder employed in the image-recording layer of the invention is a mixture of poly (ethylene glycol) (PEG) and poly(vinyl alcohol) (PVA), with the ratio of to PEG to PVA being from about 1:0.8 to about 1:1.5. The PVA employed preferably has a degree of hydrolysis ranging from 85 to 95, in order to enhance image quality. The PEG used in the image-recording layer offers enhanced resistance to coalescence when used with inks containing a high amount of humectants. The optical densities of the printed areas may also be enhanced with the addition of the PEG. The molecular weight of the PEG is chosen so that it is sufficiently high to avoid a soft, wax-like coated surface. If the molecular weight of the PEG is less than 1400, then the image quality is unacceptable.

In a preferred embodiment of the invention, the image-recording layer of the invention is coated at a coverage of about 3 to about 9 g/m$^2$.

A cationic mordant may also be used in the image-recording layer and water-absorbing layer of the invention in order to enhance bleed resistance. Examples of such a mordant include a polymeric quartenary ammonium compound, or a basic polymer, such as poly (dimethylaminoethyl)-methacrylate, polyalkylenepolyamines, and products of the condensation thereof with dicyanodiamide, amine-epichlorohydrin polycondensates; lecithin and phospholipid compounds. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium) propyl chloride. In a preferred embodiment, the cationic mordant is a quaternary ammonium compound.

The mordant which may be used in the invention can be employed in any amount effective for the intended purpose. In general, good results are obtained when the mordant is present in an amount of from about 0.3 to about 1.5/M2.

The colloidal oxide used in the image-recording layer of the invention tends to substantially densify large open structures in the porous topmost layer, resulting in improved waterfastness and image quality and increased optical densities since colorants can not travel far through the ink receptive, image-recording layer. Good results are obtained when the colloidal oxide is selected from minerals having a positive surface charge so that melt stability can be enhanced and agglomeration minimized. Preferred colloidal oxides employed in the invention include colloidal silica such as alumina-modified silica, such as Ludox® CL, (DuPont Corp.), or hydrated alumina such as Dispal® (Condea Vista Co.).

The colloidal oxide employed is present in an amount of from about 0.1 g/m$^2$ to about 1.5 g/m$^2$, preferably from about 0.3 g/m$^2$ to about 1.0 g/M$^2$.

In another preferred embodiment of the invention, the addition of a small amount of a multivalent metal salt to the image-recording layer enhances color rendition for certain dyes. There may be used, for example, calcium chloride, barium sulfate or aluminum chloride. In a preferred embodiment, calcium chloride is used. The salt may be present in an amount of from about 0.1 g/m$^2$ to about 1.0 g/m$^2$.

Another embodiment of the invention relates to an ink jet printing process comprising:

a) providing an ink jet recording element as described above, and b) applying liquid ink droplets thereon in an image-wise manner.

In another preferred embodiment, the image-recording layer may contain up to six distinct materials, each with its own function. In particular, a combination of precipitated amorphous silica, PVA, PEG, colloidal oxide, a cationic mordant, and a multivalent metal salt when taken together provide a matte image receiving surface layer with optimal image quality and durability. The relative quantities of the components may be adjusted to maximize image quality characteristics. Typical weight ranges of such materials are as follows:

Precipitated amorphous silica: 25%–70%, more preferably 35%–60%

PVA: 10%–40%, more preferably 15%–30%

PEG: 10%–40%, more preferably 15%–30%

Colloidal oxide: 5%–20%, preferably 7.5%–15%

Cationic mordant: 0%–20%, preferably 3%–15%

Multivalent salt: 0%–15%, preferably 3%–10%

The image-recording layer and/or water-absorbing layer used in the recording element of the invention can also contain various known additives, including spacer beads such as crosslinked poly(methyl methacrylate) or polystyrene beads for the purposes of contributing to the non-blocking characteristics of the recording element and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV- absorbing agents; mildew-proofing agents; mordants; antistatic agents, anti-oxidants, optical brighteners, and the like. Such additives can be selected from known compounds or materials in accordance with the objects to be achieved.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published Dec. 1989, pages 1007 to 1008. Slide coating is preferred, in which the water-absorbing layer and image-recording layer may be simultaneously applied. After coating, the layers are generally dried by simple evaporation, which may be accelerated by known techniques such as convection heating.

In order to obtain adequate coatability, additives known to those familiar with such art such as surfactants, defoamers, alcohol and the like may be used. A common level for coating aids is 0.01 to 0.30 per cent active coating aid based on the total solution weight. These coating aids can be nonionic, anionic, cationic or amphoteric. Specific examples are described in McCutcheon's Volume 1: Emulsifiers and Detergents, 1995, North American Edition.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water- soluble direct or acid type dyes. Such liquid compositions have been described extensively in the prior art including, for example, U.S. Pat. Nos. 4,381,946; 4,239,543 and U.S. Pat. No. 4,781,758, the disclosures of which are hereby incorporated by reference.

The following examples are provided to illustrate the invention.

EXAMPLES

Example 1

Waterfastness Control Element C-1 (No PEG)

A support of resin-coated photographic paper base was corona-discharge treated and then coated with a water-absorbing layer of pigskin photographic grade non-deionized gelatin (Sanofi Bio Industries Co.) and a mordant of a copolymer of poly[vinyl benzyl trimethylammonium chloride-co-ethylene glycol dimethacrylate (molar ratio of 93:7) in a ratio of 90:10 by weight. This layer was coated from a 10 weight % aqueous solution to yield a dry coating of 8.6g/m$^2$.

Simultaneously, an image-recording layer was coated comprising PVA, Elvanol® 52-22 (Dow Chemical Co.) 1.45 g/m$^2$, precipitated amorphous silica, IJ35 (Crosfield Co.), 1.85 g/m$^2$, colloidal silica, Ludox® CL (DuPont Corp.) 0.5 g/m$^2$, calcium chloride (Aldrich Co.) 0.20 g/m$^2$, and a mordant of a copolymer of poly[vinyl benzyl trimethylammonium chloride-co-ethylene glycol dimethacrylate (molar ratio of 93:7) 0.40 g/m$^2$. The image-recording layer was coated from a 10% solids dispersion to yield a dry overcoat coverage of 4.3 g/m$^2$. A small amount of surfactant 10G (Dixie Co.) was added to facilitate efficient spreading. The bottom water-absorbing layer and top image-recording layer were coated simultaneously by bead coating, chill set at 4.4° C., and dried by forced air heating.

Control Element C-2 (PEG w/high MW)

This element was the same as C-1 except that the PVA was employed at 0.73 g/m$^2$ and poly(ethylene oxide), MW 200,000, (high MW PEG) Polyox ® N-80 (Union Carbide Corp.), 0.73 g/m$^2$ was added.

Control Element C-3 (PEG:PVA ratio 1:3)

This element was the same as C-1 except that the PVA was employed at 1.1 g/m$^2$ and PEG, MW 33,500, (Fluka Corp.), 0.36 g/m$^2$ was added.

Element 1 of the Invention

This element was prepared similar to C-3 except that the PVA was employed at 0.73 g/m$^2$ and the PEG was employed at 0.73 g/m$^2$.

Coalescence

Each of the above receivers was printed using an Epson Stylus Photo® printer and a color ink cartridge model SO20110 (Epson Co.) and qualitatively evaluated for degree of coalescence. Coalescence is described as undesirable local variations in optical density in a patch of solid color resulting from puddling or beading of the ink. In the case of the Epson Stylus Photo® printer, such an effect is especially pronounced in areas of solid green.

Optical Density and Light-fastness

The optical densities of solid color patches of cyan, magenta, yellow and black, printed using a Hewlett-Packard 890C printer and an HPC1823A color cartridge and a HPS1645A black cartridge were obtained from an X-Rite® 310 Photographic Densitometer. The patches were then subjected to 50 KLux high intensity daylight radiation for 7 days and the optical density remeasured. The final optical density divided by the initial optical density times 100 is a measure of the light-fastness. High values are preferred. Only the yellow ink colorant was measured since it is the least stable colorant for this ink set. The following results were obtained:

TABLE 1

| | Green | | Initial Optical Density | | | |
|---|---|---|---|---|---|---|
| Element | Coalescence | Light-fastness | C | M | Y | B |
| C-1 | Heavy | 28 | 0.98 | 1.61 | 1.51 | 1.57 |
| C-2 | Slight | 9 | 1.2 | 1.63 | 1.53 | 1.55 |

TABLE 1-continued

| Green | | | Initial Optical Density | | | |
|---|---|---|---|---|---|---|
| Element | Coalescence | Light-fastness | C | M | Y | B |
| C-3 | Heavy | 19 | 1.09 | 1.68 | 1.55 | 1.62 |
| 1 | None | 18 | 1.16 | 1.67 | 1.57 | 1.66 |

The above data show that the presence of PEG in Element 1 of the invention increases optical density and reduces coalescence as compared to C-1 which had no PEG. If the PEG has a high molecular weight (C-2) as compared to Element 1 of the invention, light-fastness is reduced. If the ratio of PEG:PVA is lower (C-3) than the ratio used in Element 1 of the invention, then the coalescence is increased.

Example 2

PEG Molecular Weight

Control C-4 - Low MW PEG

This element was similar to Element 1 except that the MW of the PEG is 400.

Element 2 of the Invention

This element was the same as C-4 except that the MW of the PEG is 1450.

Element 3 of the Invention

This element was the same as C-4 except that the MW of the PEG is 6000.

Element 4 of the Invention

This element was the same as C-4 except that the MW of the PEG is 10,000.

Element 5 of the Invention

This element was the same as C-4 except that the MW of the PEG is 20,000.

Bleed Test

The above elements and Element 1 from Example 1 were printed using an Epson Stylus Photo® printer and cartridges described above in Example 1 and were qualitatively evaluated for bleed, i.e., the lack of edge definition. The following results were obtained.

TABLE 2

| Element | PEG molecular weight | Bleed |
|---|---|---|
| C-4 | 400 | Heavy |
| 2 | 1,450 | Some |
| 3 | 6,000 | Some |
| 4 | 10,000 | None |
| 5 | 20,000 | None |
| 1 | 33,500 | None |

The above results show that if the PEG molecular weight is below about 1400, then bleed is more pronounced.

Example 3

PEG:PVA Ratio

Control C-5

PEG:PVA ratio of 1:0

This element was similar to Element 1 except that no PVA was present and the PEG amount was 1.45 g/m$^2$.

Control C-6

PEG:PVA ratio of 1:0.5

This element was similar to Element 1 except the PVA was present at 0.48 g/m$^2$ and the PEG amount was 0.97 g/m$^2$.

Control C-7

PEG:PVA ratio of 1:1.9

This element was similar to Element 1 except the PVA was present at 0.95 g/m$^2$ and the PEG amount was 0.50 g/m$^2$.

Rub Test

Each of the above control elements and Element 1 of Example 1 was evaluated qualitatively for rub resistance by gently rubbing with a finger and noting either removal or deformation of the ink receiving layer.

Coalescence

Each of the above control elements and Element 1 of Example 1 were printed using an Epson Stylus Color 600 ink jet printer and SO20089 color cartridge and evaluated for coalescence as in Example 1. The following results were obtained:

TABLE 3

| Element | Ratio of PEG:PVA | Rub Resistance | Coalescence |
|---|---|---|---|
| C-5 | 1:0 | Poor | None |
| C-6 | 1:0.5 | Poor | None |
| C-7 | 1:1.9 | Good | Heavy |
| 1 | 1:1 | Good | None |

The above results show that if no PVA is present (C-5), the rub resistance is poor. If the ratio of PEG:PVA is higher (C-6) than the ratio of these materials in Element 1 of the invention, then the rub resistance is also poor. If the ratio of PEG:PVA is lower (C-7) than the ratio of these materials in the element of the invention, then the coalescence is poor.

Example 4

Use of Salt in Image-Recording Layer

Element 6 of the Invention

This element was similar to Element 1 except that there was no calcium chloride and the precipitated amorphous silica was present at a concentration of 2.05 g/m$^2$.

Printing

Solid patches of color were printed on Elements 6 and 1 using a Hewlett-Packard Photosmart printer and C3844A and C3845A cartridges. Solid patches of color were also printed on Elements 6 and 1 using a Lexmark 7200 inkjet printer using a 12A1980 color cartridge and a 12A1990 Photo cartridge. The optical densities of the cyan, magenta and yellow patches were measured as in Example 1. The following results were obtained:

TABLE 4

| | Optical Density | | | | | |
|---|---|---|---|---|---|---|
| | HP Photosmart | | | Lexmark 7200 | | |
| Element | Cyan | Magenta | Yellow | Cyan | Magenta | Yellow |
| 1 | 1.49 | 1.46 | 1.46 | 0.85 | 0.93 | 1.2 |
| 6 | 1.56 | 1.44 | 1.48 | 0.91 | 0.95 | 1.2 |

The above results show that when the $CaCl_2$ is not present (Element 6), cyan density increases while magenta and yellow stay constant. Thus the presence of a metal salt is useful in adjusting the color balance.

Example 5

Effect of Colloidal Oxide and Mordant

Element 7 of the Invention

This element is the same as Element 1 except no mordant was present.

Control C-8

No Colloidal Oxide

This element was the same as Element 1 except the colloidal silica was removed.

Control C-9

No Pigment

This element was the same as Element 1 except that there was no precipitated amorphous silica and the PVA and PEG amounts were each increased to 1.62 g/$m^2$.

Printing and Coalescence

For each of the above elements and Element 1 of the invention, qualitative evaluations of coating quality and coalescence were made. Coalescence was measured as in Example 1. Coating quality is evaluated by a visual inspection of the coated element for undesirable coating streaks and agglomerates. The following results were obtained:

TABLE 5

| Element | Coating Quality | Coalescence |
|---|---|---|
| 1 | Good | Good |
| 7 | Good | Good |
| C-8 | Good | Poor |
| C-9 | Poor | Poor |

The above results show that removal of pigment (C-9) or the colloidal oxide (C-8) results in poor coalescence and/or coating quality as compared to the elements of the invention.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a water-impervious support having thereon the following layers:

a) a water-absorbing layer; and b) an image-recording layer comprising a colloidal oxide and a pigment dispersed in a binder, said binder comprising a mixture of poly(ethylene glycol) having a molecular weight of from about 1400 to about 35,000 and poly(vinyl alcohol), the ratio of said poly(ethylene glycol) to said poly(vinyl alcohol) being from about 1:0.8 to about 1:1.5.

2. The recording element of claim 1 wherein said pigment is precipitated amorphous silica.

3. The recording element of claim 1 wherein said water-absorbing layer is gelatin.

4. The recording element of claim 1 wherein said image-recording layer contains a cationic mordant.

5. The recording element of claim 1 wherein said colloidal oxide is colloidal silica.

6. The recording element of claim 1 wherein said image-recording layer contains a multivalent metal salt.

7. The recording element of claim 6 wherein said multivalent metal salt is calcium chloride.

8. The recording element of claim 1 wherein said image-recording layer is coated at a coverage of about 3 to about 9 g/$m^2$.

9. The recording element of claim 1 wherein said water-absorbing layer is coated at a coverage of about 2 to about 16 g/$m^2$.

10. An ink jet printing process comprising:

a) providing an ink jet recording element according to claim 1, and b) applying liquid ink droplets thereon in an image-wise manner.

* * * * *